US008695282B2

(12) United States Patent
Glander

(10) Patent No.: US 8,695,282 B2
(45) Date of Patent: Apr. 15, 2014

(54) RAIN GUTTER WITH INTEGRAL REINFORCING MEMBER AND GUTTER GUARD

(76) Inventor: Tony Glander, Rathdrum, ID (US)

( * ) Notice: Subject to any disclaimer, the term of this patent is extended or adjusted under 35 U.S.C. 154(b) by 0 days.

(21) Appl. No.: 12/931,444

(22) Filed: Feb. 1, 2011

(65) Prior Publication Data

US 2012/0192502 A1 Aug. 2, 2012

(51) Int. Cl.
*E04D 13/00* (2006.01)
*E04D 13/08* (2006.01)

(52) U.S. Cl.
USPC ..... 52/11; 52/12; 52/13; 52/14; 52/15; 52/16

(58) Field of Classification Search
USPC ..... 52/11–16
See application file for complete search history.

(56) References Cited

U.S. PATENT DOCUMENTS

| | | | | | |
|---|---|---|---|---|---|
| 1,105,390 | A | | 7/1914 | Whedon | |
| 2,988,226 | A | | 6/1961 | Campbell | |
| 4,727,689 | A | * | 3/1988 | Bosler | 52/12 |
| 4,905,427 | A | * | 3/1990 | McPhalen | 52/12 |
| 5,271,192 | A | * | 12/1993 | Nothum et al. | 52/12 |
| 5,595,027 | A | * | 1/1997 | Vail | 52/12 |
| 5,619,825 | A | * | 4/1997 | Leroney et al. | 52/12 |
| 5,893,240 | A | | 4/1999 | Ealer, Sr. | |
| 6,016,631 | A | * | 1/2000 | Lowrie, III | 52/12 |
| 6,151,837 | A | * | 11/2000 | Ealer, Sr. | 52/12 |
| 6,786,008 | B2 | | 9/2004 | Brochu | |
| 6,826,872 | B2 | | 12/2004 | Brochu | |
| 7,340,863 | B1 | | 3/2008 | Dressler | |
| 7,614,185 | B2 | * | 11/2009 | Brochu | 52/11 |
| 8,001,729 | B2 | * | 8/2011 | Joly et al. | 52/12 |
| 2002/0166290 | A1 | * | 11/2002 | Bergeron | 52/12 |
| 2004/0060244 | A1 | * | 4/2004 | Brochu | 52/12 |
| 2004/0118052 | A1 | * | 6/2004 | Brochu | 52/12 |
| 2005/0204642 | A1 | * | 9/2005 | Valentini | 52/12 |
| 2008/0010906 | A1 | | 1/2008 | Brochu | |
| 2008/0047206 | A1 | | 2/2008 | Gramling | |
| 2009/0056234 | A1 | * | 3/2009 | Brochu | 52/12 |
| 2009/0108144 | A1 | | 4/2009 | Brochu | |
| 2011/0138698 | A1 | * | 6/2011 | Neumann | 52/12 |

* cited by examiner

*Primary Examiner* — Mark Wendell
(74) *Attorney, Agent, or Firm* — Paine Hamblen, LLP

(57) ABSTRACT

A gutter guard for use with a K-style rain gutter includes a substantially flat center section, a guard rear flange extending from the center section and a guard lip extending from the guard rear flange. Also extending from the center section is an L-shaped guard front flange that includes a first leg joined with the center section and a second leg extending from the first leg. The guard is adapted to fit in the gutter so that a lower outside corner of the guard is nested within a first inside corner of the gutter, an upper outside corner of the guard is nested within a second inside corner of the gutter, the second leg of the guard is nested within a close inside corner of the gutter, and at least a portion of a rear wall of the gutter is nested between the guard lip and the guard rear flange.

1 Claim, 6 Drawing Sheets

FIG. 5A

RAIN GUTTER WITH INTEGRAL REINFORCING MEMBER AND GUTTER GUARD

BACKGROUND

Rain gutters have long been used on many types of structures including commercial and residential buildings. One purpose of rain gutters is to collect rainwater runoff from a roof of a structure and divert the collected runoff away from the building through the use of downspouts and the like. Rain gutters are typically formed from a length of sheet metal such as sheet steel or sheet aluminum. Rain gutters are frequently formed in a continuous, progressive forming process in which the sheet metal is pulled into a forming machine from a large roll supported on a rotating spool. In some instances, gutters are formed at the installation site. In other instances, premade gutter sections of standard or custom lengths are shipped to the installation site. A common problem associated with the use of a rain gutter is that leaves, seed pods, dirt and other debris tends to collect in the gutter, which often hinders the function of the gutter. The process of cleaning debris from rain gutters can be laborious, unsavory and dangerous. Various types of gutter guards have been developed in an attempt to reduce accumulation of debris in rain gutters. Various detriments can be associated with the use of conventional rain gutter guards.

Further, gutters are oftentimes subjected to external loads or forces, such as: an accumulation of ice, snow, water and/or debris, either within the gutter itself or on the upper surface of a gutter guard; the weight of a person stepping on the gutter and/or the gutter guard (as for example, when clearing debris from a rooftop); and forces applied by a ladder or the like leaning against the front edge of the gutter. These external loads and forces can cause irreversible damage to gutters (e.g., by deforming the gutter beyond its natural ability to resiliently spring back), and can also cause gutter guards to collapse into the gutter itself.

DETAILED DESCRIPTION

In general, the present disclosure provides for a combination reinforcing-member/gutter-guard ("reinforcing member/gutter guard") for use with a K-shaped gutter. The combination reinforcing member/gutter guard not only acts as a gutter guard to resist the migration of solids into the gutter, but also results in a gutter assembly which is highly resistant to external loads and forces which would otherwise cause damage to the gutter and/or prior art type gutter guards.

Figure 1:
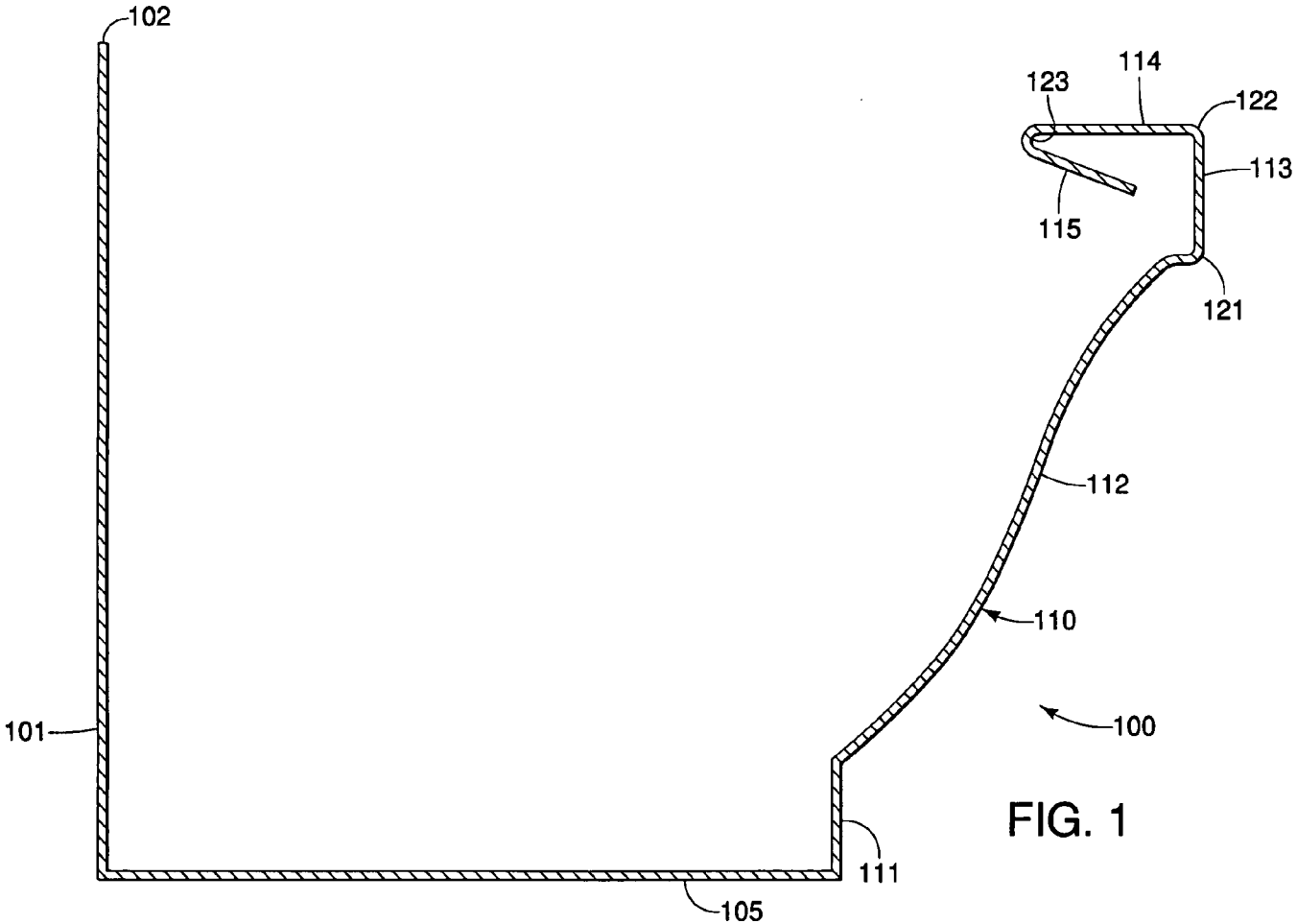
FIG. 1 is an end view of a conventional K-style rain gutter.

Several types of rain gutters are known in the art. One type of rain gutter is known as the K-style gutter. With reference to the drawing figures included herewith, FIG. 1 is an end view of a K-style open-ended rain gutter section 100. The following description of the K-style rain gutter 100 is provided to promote a more thorough understanding of one or more inventions for use therewith as discussed herein. The rain gutter 100 includes a rear wall 101, a bottom wall 105, and a front wall 110. Generally, the rear wall 101 is placed adjacent to a structure (not shown) onto which the gutter is installed. The rear wall 101 can be substantially flat as depicted. The bottom wall 105 can be substantially flat, as is depicted. The rear wall 101 extends from the bottom wall 105 as shown. The rear wall 101 can be substantially perpendicular to the bottom wall 105. The rear wall 101 terminates at a rear upper edge 102.

The front wall 110 can include a lower wall portion 111, an intermediate wall portion 112, an upper wall portion 113, a flange 114 and a lip 115. The lower wall portion 111 extends from the bottom wall 105, and can be substantially parallel to the rear wall 101. The intermediate or curved wall portion 112 is joined with the lower wall portion 111, and can be curved as depicted. The curved wall portion 112 can generally slope upwardly and outwardly from the lower wall portion 111. The upper wall portion 113 is joined with the intermediate wall portion 112, and is distal from the lower wall portion 111. The upper wall portion 113 can be substantially parallel with the rear wall 101. The gutter flange 114 extends toward the rear wall 101 from the upper wall portion 113. The flange 114 is joined with the upper wall portion 113 distally from the intermediate wall portion 112. The flange 114 can be substantially parallel with the bottom wall 105.

The lip 115 is joined to the flange 114 distally from the upper wall portion 113. The gutter lip 115 extends from the gutter flange 114 and extends away from the rear wall 101. According to the exemplary form of the gutter 100, the lip 115 extends from the flange 114 to form an acute angle therewith. The curved wall portion 112 and the upper wall portion 113 join to form a first inside corner 121 there between. The upper wall portion 113 and the flange 114 join to form a second inside corner 122 there between. The flange 114 and the lip 115 join to form a close inside corner 123 there between. It is understood that angles and/or orientations between and/or relative to two or more portions of the gutter 100 as well as dimensions thereof that are described, depicted or otherwise represented herein are subject to variations due to manufacturing tolerances) and/or minor differences in design and/or configuration.

Figure 2:
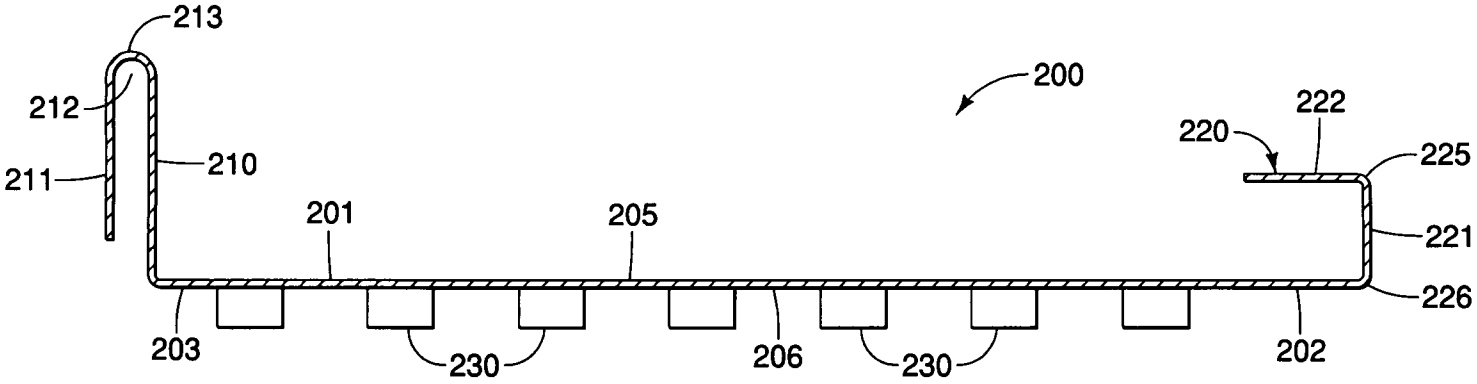
FIG. 2 is an end view of a combination reinforcing member and gutter guard.

Moving now to FIG. 2, an end view of a rain gutter reinforcing member 200 is shown according to at least one embodiment of one or more inventions discussed herein. The rain gutter reinforcing member 200 is intended for use in conjunction with one or more K-style rain gutters such as the gutter 100 shown and described herein with respect to FIG. 1. More specifically, the reinforcing member 200 is primarily intended to be installed on, or in, a K-style gutter for the purpose of strengthening the gutter 100. According to at least one embodiment of the reinforcing member 200, the reinforcing member is formed from an elongate strip of sheet material such as sheet metal, using a forming method similar to one or more methods used for forming conventional rain gutters. The reinforcing member 200 includes a center section 201. The center section 201 can be substantially flat, as depicted. The center section 201 can have an upper surface 205 and an opposite lower surface 206. The center section 201 has a front side or edge 202 and an opposite distal rear side or edge 203. The reinforcing member 200 is provided with openings 230 in the center section 201 (as described below) to allow water to flow off of the upper surface 205 of the member 200. Since the openings 230 can assist in preventing solid detritus (such as leaves, etc.) from entering the gutter 100, the reinforcing member can also act as a gutter guard. Hence, in the following description the reinforcing member 200 will also be referred to as the "gutter guard" or merely "guard" for the sake of brevity.

The guard 200 includes a guard rear flange 210. The rear flange 210 extends from the upper surface 205 of the center section 201. The rear flange 210 can extend substantially normally from the center section 201. The guard rear flange 210 is located proximate the rear edge 203 of the center section 201 according to at least one exemplary embodiment of the guard 200. The guard 200 can include a guard lip 211. The guard lip 211 is joined to the guard rear flange 210. The lip 211 can be joined to the rear flange 210 at a location thereon which is distal from the center section 201. According to at least one embodiment of the guard 200, the lip 211 is in substantially spaced apart, parallel juxtaposed relation to the rear flange 210 as depicted in FIG. 2. According to at least one embodiment of the guard 200, the guard rear flange 210 and the guard lip 211 are formed from a single section of sheet material by creating a fold therein. Examination of FIG. 2 reveals that a gap 212 can be defined between the rear flange 210 and the lip 211. The gap 212 has a closed end 213 according to an exemplary embodiment of the guard 200. The closed end 213 can be located distally from the center section 201 as depicted.

Still referring to FIG. 2, the guard 200 includes a guard front flange 220. The front flange 220 extends from the upper surface 205 of the center section 201. The guard front flange 220 is located proximate the front side 202 of the center section 201 according to at least one exemplary embodiment of the guard 200. The front flange 220 can be substantially L-shaped as depicted. Specifically, the front flange 220 can include a first leg 221 and a second leg 222. The first leg 221 is joined with the center section 201 proximate the front side 202 thereof. The first leg can extend substantially normally from the center section 201. The second leg 222 extends from the first leg 221. The second leg 222 is joined with the first leg 221 at a location thereon which is distal from the center section 201. The second leg 222 can extend substantially normally from the first leg 221. The second leg 222 can extend from the first leg 221 substantially toward the rear flange 210 as depicted. With continued reference to FIG. 2, an upper outside corner 225 is defined at a junction of the first leg 221 and the second leg 222. Similarly, a lower outside corner 226 is defined at a junction of the first leg 221 and the center section 201.

Still referring to FIG. 2, the guard 200 includes a plurality of openings or apertures 230. The openings 230 are intended to allow passage there through of rain water while substantially inhibiting or reducing passage there through of various types of debris (not shown) such as, but not limited to, leaves, seed pods, twigs and the like. According to various alternative embodiments of the guard 200, the openings 230 can have one or more specific configurations. For example, the openings 230 can be in the form of a simple aperture defined through the center section 201 of the guard 200 according to at least one embodiment thereof. According to the exemplary embodiment of the guard 200 as depicted in the accompanying drawing figures, the openings 230 can be substantially in the form of louvers. Such louvers 230 can be formed within the center section 201 of the guard 200 according to one or more various manufacturing and/or forming techniques now known or yet to be developed. Such louver-forming techniques include, for example, punching and/or stamping. It is to be understood that the openings 230 can have shapes and/or configurations other than those specifically depicted and/or described herein. For example, although the openings 230 are illustratively depicted as having a rectilinear shape, it is to be understood that the openings can have other shapes such as, but not limited to, circular. In one variation the openings 230 comprise between about 20 to 25 percent of the surface area of the upper surface 205 of the center section 201 of the reinforcing member 200; in another variation the openings 230 comprise less than about 20 percent of the surface area of the upper surface 205. The reason for limiting the area of the openings 230 is to preserve the integrity of the reinforcing member 200. The use of louvered openings 230 (as depicted in FIG. 2) further facilitates in retaining the strength properties (i.e., resistance to bending and deformation) of the reinforcing member 200. Additionally, although not depicted as being so in FIGS. 2 and 4 (described below), the openings 230 can be also staggered from row to row to facilitate in retaining the strength properties of the reinforcing member 200.

Figure 3:
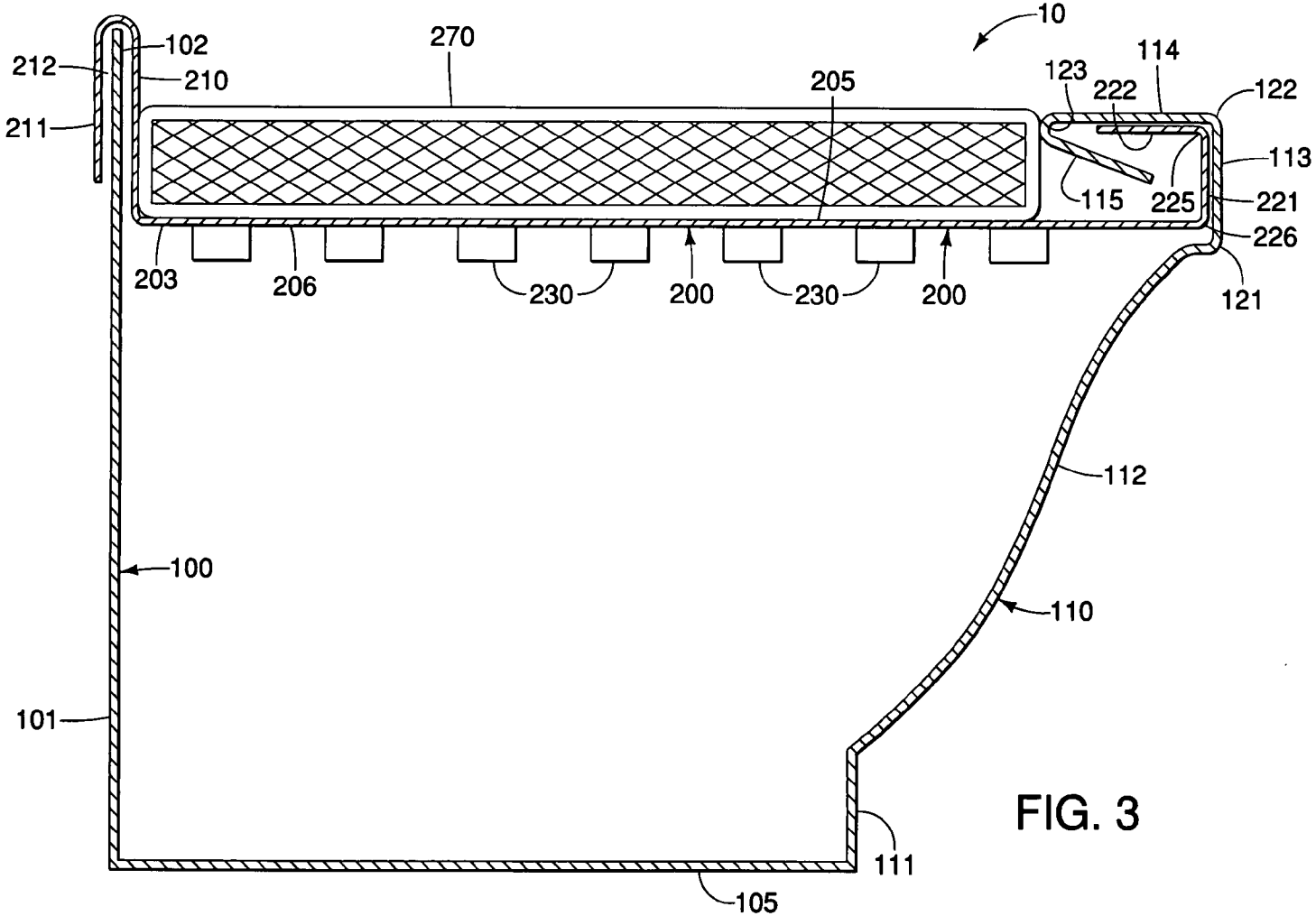
FIG. 3 is an end view of the reinforcing member/gutter guard of FIG. 2 installed in the gutter of FIG. 1, with an optional mesh material installed.

Turning now to FIG. 3, an end view shows an illustrative example of the reinforcing member/gutter guard 200 that is installed within the K-style gutter 100. With reference to FIGS. 1-3, the second leg 222 of the guard 200 is nested within the closed corner 123 of the gutter 100, according to the illustrative example of the guard installation. The lower outside corner 226 of the guard 200 is nested within the first inside corner 121 of the gutter 100 according to the illustrative guard installation. The lower outside corner 226 of the guard 200 can be in contact with the first inside corner 121 of the gutter 100, or in near proximity thereto (for example, within about 5 mm or less, and preferably about 3 mm or less). It will be noted in the example depicted in FIG. 3 that then the guard 200 is installed in the gutter 100, the first leg 221 of the guard 200 is essentially parallel to the upper wall portion 113 of the gutter, and that the first leg 221 projects upward and away from the lower outside corner 226 of the guard 200 and the first inside corner 121 of the gutter 100. Also according to the exemplary installation, the upper outside corner 225 of the guard 200 is nested within the second inside corner 122 of the gutter 100. Further examination of FIGS. 1-3 shows that installation of the guard 200 within the gutter 100 can result in the rear upper gutter edge 102 being substantially nested within the gap 212 that is defined between the guard rear flange 210 and the guard lip 211.

As depicted in FIG. 3, the rear upper gutter edge 102 of the gutter 100 can be simply fitted between the guard rear flange 210 and the guard lip 211 in the gap 212. However, in one variation one or both of the guard rear flange 210 and/or the guard lip 211 can be secured to the rear wall 101 of the gutter 100 proximate the rear upper gutter edge 102 of the gutter 100 by securing means such as welding, soldering, riveting, or other known securing means which allow the guard rear flange 210 and/or the guard lip 211 to entrap the rear wall 101 of the gutter 100 proximate the rear upper gutter edge 102.

While the gutter lip 115 of the gutter 100 is depicted in FIG. 3 as being set at an angle to the second leg 222 of the guard 200, the lip 115 can also be folded over closer to second leg 222, and can also be parallel to and/or in contact with second leg 222 to form a more rigid structure between the gutter 100 and the guard 200. Further, the second leg 222 of the guard 200 can be crimped between the lip 115 and the flange 114 of the gutter 100. Also, in FIG. 3 a gap is depicted as being formed between lower outside corner 226 of the guard 200 and first inside corner 121 of the gutter 100. In other arrangements within the scope of the present disclosure the lower outside corner 226 can be fitted tightly into the first inside corner 121 so that there is no gap therebetween.

Still referring to FIGS. 1-3, installation of the guard 200 within a K-style gutter such as the gutter 100 can result in the guard front flange 220 being nested within the gutter upper wall portion 113 and the gutter flange 114 and the gutter lip 115. Similarly, such an installation of the guard 200 can result in at least an upper portion of the gutter rear wall 101 being nested within the guard gap 212, at least a portion of which is defined by the guard rear flange 210 and the guard lip 211. Although the illustrative installation of the guard 200 within the gutter 100 as depicted in FIG. 3 does not show substantial contact between the guard and the gutter, it is to be understood that substantial contact between the guard and the gutter can occur according to at least one embodiment of the guard 200.

As can be appreciated by viewing FIG. 3, the gutter guard 200 is particularly useful in resisting loads (such as snow, ice, and even body weight) which can be applied to the upper surface 205 of the guard 200. In particular, when weight is applied to the upper surface 205 of the guard 200, the lower outside corner 226 of the guard 200 is forced into the first inside corner 121 of the gutter 100. The concave shape (as viewed from outside the gutter) in the curved wall portion 112 immediately below the first inside corner 121 of the gutter 100 facilitates in keeping the lower outside corner 226 of the guard 200 nested in the first inside corner 121 of the gutter 100 even when loads are applied to the gutter guard 200. Further, since the lower outside corner 226 of the guard 200 is essentially nested in the first inside corner 121 of the gutter 100 even when no loads are applied to the gutter guard 200, there is little to no downward movement of the lower outside corner 226 of the guard 200 when a load is applied to the upper surface 205 of the guard. This allows substantial loads to be applied to the upper surface 205 of the gutter guard 200 without the guard either collapsing into the gutter 100, or the front wall 110 of the gutter collapsing outward.

As depicted in FIG. 3, the first leg 221 of the guard 200 and the upper wall portion 113 of the gutter are not secured to one another by fasteners or other means. In one variation, the first leg 221 of the guard 200 and the upper wall portion 113 of the gutter can be secured to one another by fasteners (such as sheet metal screws or rivets, for example) or by other means (such as welding or crimping, for example).

With continued reference to FIG. 3, the guard 200, according to at least one embodiment thereof, can include a mesh material 270. The mesh material 270 can, for example, be in the form of woven screen or expanded metal or perforated sheet or the like. The mesh material 270 can be configured to be substantially flush with at least a portion of the guard 200. For example, according to the illustrative example depicted in FIG. 3, the mesh material 270 is configured to be substantially flush with the second leg 222 of the gutter guard 200 when installed therein as shown. This configuration (of allowing the mesh material 270 to be substantially flush with the second leg 222 of the gutter guard 200) allows detritus which may accumulate on the upper surface of the mesh material 270 to be flushed off of the upper surface of the mesh material 270 and over the second inside corner 122 of the gutter 100, and in particular when the gutter 100 (and the guard 200) are angled outward (i.e., in a clockwise direction, as viewed from the perspective of the rear upper edge 102 of gutter 100 in FIG. 3).

Figure 4:
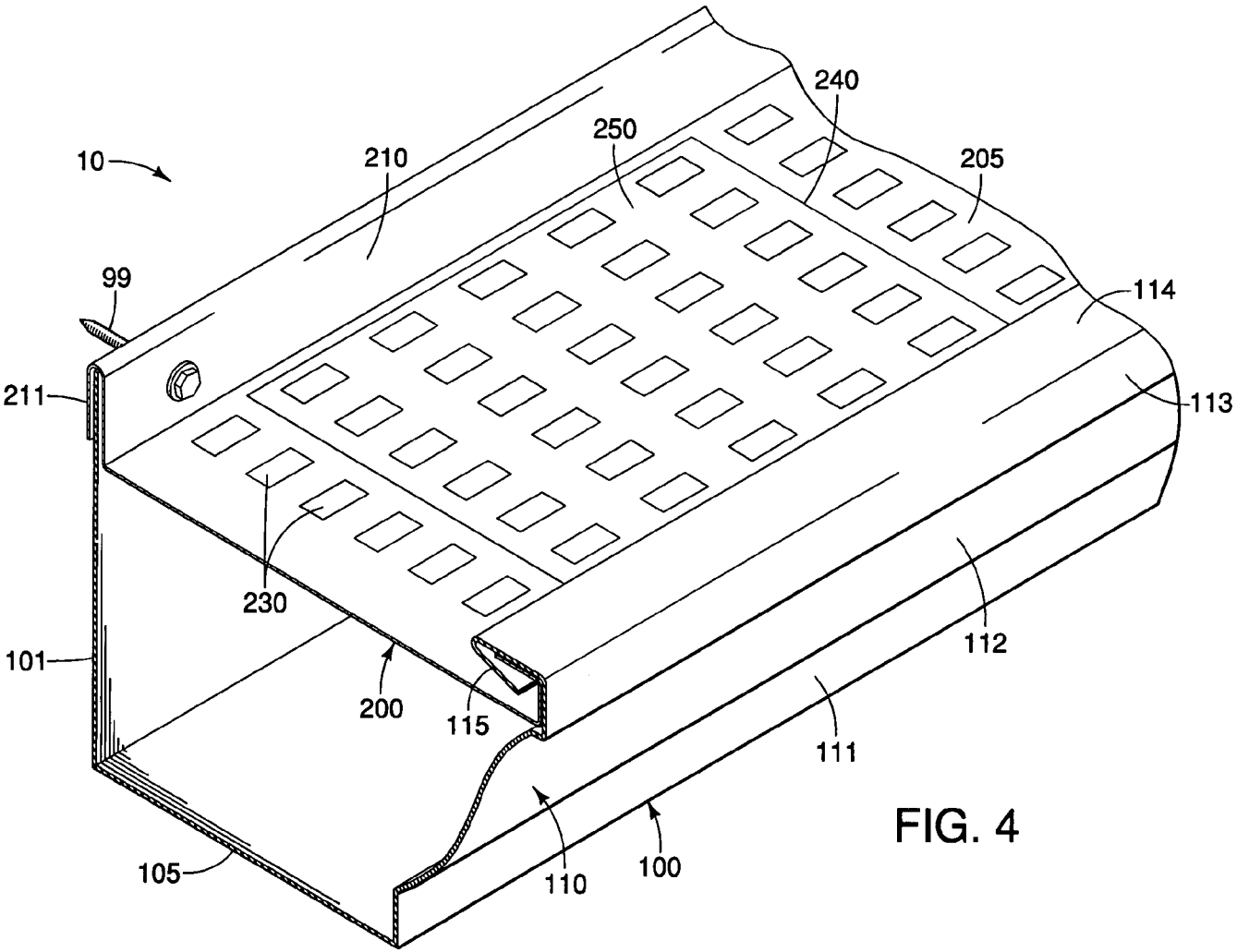
FIG. 4 is an isometric view of the reinforcing member/gutter guard installed in the gutter.

Turning now to FIG. 4, an isometric view shows the guard 200 installed within the K-style gutter 100. As is seen from a study of FIG. 4, the guard 200 can be configured to define there through a cleanout opening 240. The cleanout opening 240 can be provided to allow access to the gutter 100 beneath the guard without removing or uninstalling the guard from the gutter. The guard 200 can also include an access panel 250. The access panel 250 can be adapted to fit closely within the cleanout opening 240. One or more types of conventional securing means (not shown) can be used to secure the access panel 250 in place within the cleanout opening. It is to be understood that, although the cleanout opening 240 and the access panel 250 are depicted as having substantially rectilinear shapes, the opening and panel can have any of a number of possible alternative shapes and/or configurations. An installation means 99 can be employed to mount or install the gutter 100 to a structure (not shown). The installation means 99 can be employed to substantially secure the gutter guard 200 to a structure and/or to the gutter 100. The installation means 99 can have one of a number of possible configurations such as, but not limited to, a conventional fastener such as a screw (depicted) or a nail. According to the illustrative example depicted in FIG. 4, the installation means is substantially in the form of one or more fasteners that pass through the guard rear flange 210, as well as the gutter rear wall 101 and the guard lip 211.

Once the gutter system 10 (which includes the gutter 100 and the reinforcing member/guard 200) is installed as depicted in FIG. 4, the assembly of the gutter 100 and gutter guard 200 form an essentially box-shaped structure (as viewed from the end, as depicted in FIG. 3) which is resistant to deformation which can lead to failure of the gutter system 10. That is, when a load is applied to the upper surface 205 of the reinforcing member/gutter guard having a substantial normal (or perpendicular) load component (with respect to the upper surface 205 of the guard 200, such as can be experienced by ice or snow accumulation on the surface 205, or by a person stepping on the upper surface 205 and/or on the flange 114 of the gutter) the gutter guard 200 will resist collapse into the gutter 100 due to the structural strength provided by the integral association of the gutter 100 with the reinforcing member/gutter guard 200 (and more specifically, the close nesting of the outside corner 226 of the guard 200 into the first inside corner 121 of the gutter 100). It will also be appreciated that a load component normal to the upper surface 205 of the guard 200 will cause the concave curve portion (as viewed from outside the gutter 100) of the curved wall portion 112 to be forced inward toward the lower surface 203 of the guard 200, thus creating further resistance for movement of the outside corner 226 of the guard 200 into the curved wall portion 112 (which could lead to the guard 200 failing into the gutter 100). Further, when a load is applied to the upper wall portion 113 of the gutter 100 which has a substantial normal component (i.e., a force vector component essentially perpendicular (or normal) to the surface of the upper wall portion 113) as can be experienced, for example, by a ladder being leaned against the gutter 100 at the upper wall portion 113, the gutter guard 200 will resist collapse into the gutter 100 due to the fact that the concave curve portion (as viewed from outside the gutter 100) of the curved wall portion 112 will be forced into compression, causing the inside corner 121 of the gutter 100 to be pressed into the outside corner 226 of the guard 200, thus resisting collapse of the forward edge of the guard 200 (at outside corner 226) into the gutter 100 at the curved wall portion 112 of the gutter 100.

Figure 5:
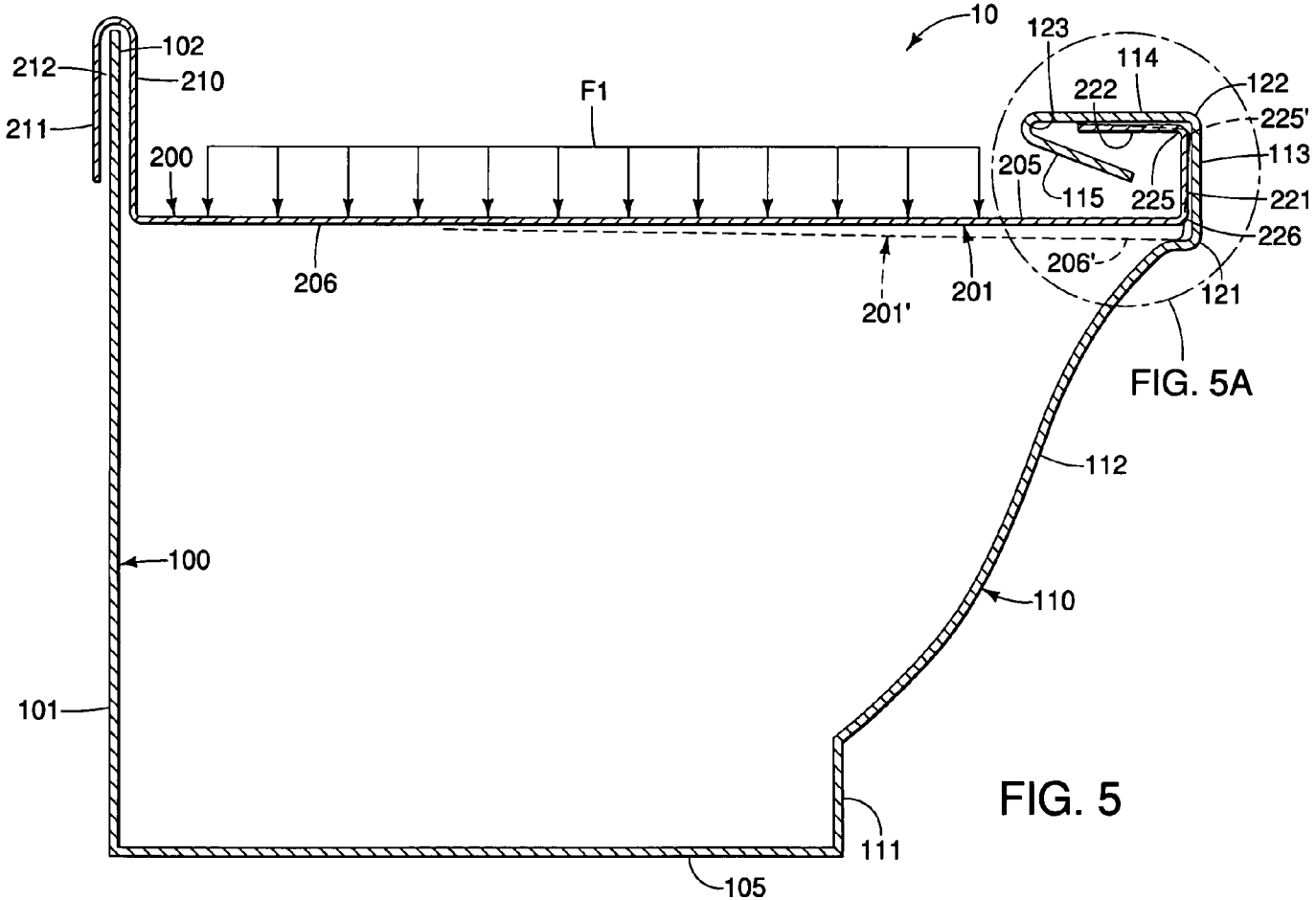
FIG. 5 is an end view of the gutter apparatus similar to that depicted in FIG. 3, but depicting how a distributed load can be applied to the upper surface of the reinforcing member/gutter guard.

For example, with reference to FIG. 5 (which is generally the same side view of the apparatus 10 as depicted in FIG. 3), when a distributed load "F1" is placed on the upper surface 205 of the center section 201 of guard (or reinforcing member) 200, the center section will be moved to the position indicated by dashed line 201'. More specifically, referring to FIG. 5A (which is a detail of the forward section of the apparatus 10 depicted in FIG. 5), the load F1 (of FIG. 5) will cause the lower surface 206 of the center section 201 to move to position 206', and the first leg 221 of the front flange 220 (FIG. 2) will be moved to position 221'. This will cause the lower outside corner 226 of guard 200 to move to position 226', thus nesting the corner 226 of guard 200 in the first inside corner 121 of the K-shaped gutter 100. Likewise, the upper outside corner 225 of the guard 200 will be moved to position 225', thus nesting the corner 225 of guard 200 in the second inside corner 122 of the K-shaped gutter 100. Further, the second leg 222 of front flange 22 of guard 200 is pushed into position 221', and into tight contact with the inside of flange 114 of gutter 100. The deformation of components 201, 206, 221, 222, 225 and 226 is slightly exaggerated in FIGS. 5 and 5A in order to demonstrate how these components move under the load F1 (FIG. 5). Further, the K-shaped gutter 100 (and particularly, front wall 110) will deform slightly so that first leg 221 of the guard 200, and upper wall portion 113 of the gutter 100, tend to stay more parallel to one another than as depicted in FIG. 5A by line 221'.

Figure 5A:
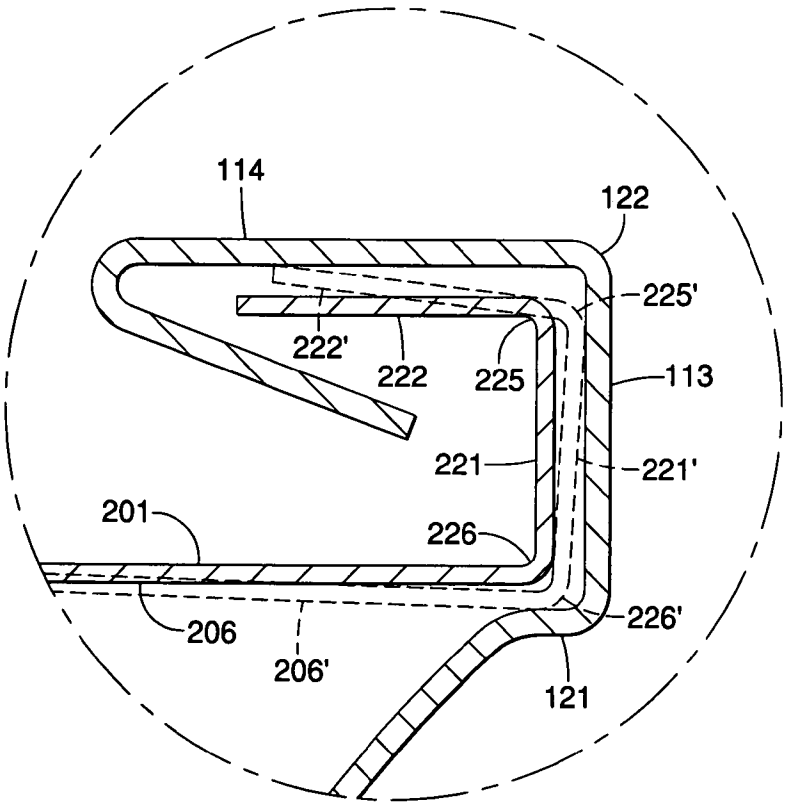
FIG. 5A is a detail of the upper front gutter section from FIG. 5.

As can be seen from FIGS. 5 and 5A, the distributed load "F1" (FIG. 5) on the upper surface 205 of the guard 200 results in (1) very little deformation of the guard 200 and gutter 100, and (2) tends to force the front flange 220 of the guard 200 into closer contact with the upper wall portion 113, and corners 121 and 122, of the gutter 100. In this way the guard 200 resists collapse into the gutter even under very high load placed on the upper surface 205 of the guard 200.

Figure 6:
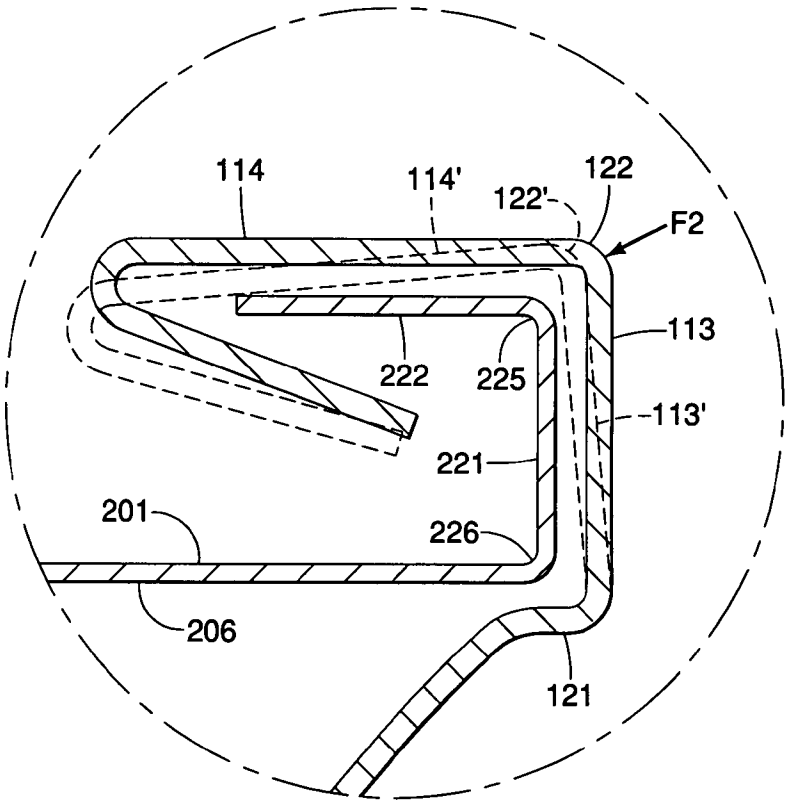
FIG. 6 is a detail similar to FIG. 5A but depicting how a point load can be applied to the gutter.

Turning now to FIG. 6 (which is a side elevation detail of the same area of the apparatus 10 as depicted in FIG. 5A), a point load "F2" can be applied against the second inside corner 122 of the gutter 100 (FIG. 3) via a ladder or the like being rested against the outer surface (not specifically numbered) of the corner 122. Load F2 will cause the upper wall portion 113 of the gutter 100 to move slightly inward to position 113', and will also cause flange 114 of the gutter to move to the position indicated by line 114'. Under extreme loads of force F2, the second inside corner 122 of the gutter 100 will come into contact with the upper outside corner 225 (FIG. 5A) of the guard 200. As can be seen, in position 114' the flange 114 comes to rest against the second leg 222 of the guard 200. In this way, notwithstanding load F2, the guard 200 remains locked within the area defined by corner 121, upper wall portion 113, and flange 114 of gutter 100. The deformation of flange 114 under load F2, as depicted in FIG. 6, is slightly exaggerated for the purposes of demonstrating the principle of operation.

As can further be appreciated by viewing FIGS. 5A and 6 in conjunction, the combination of a distributed load F1 (FIG. 5) on the upper surface 205 of the guard 200, and a point load F2 (FIG. 6) on the second inside corner 122 of the gutter 100, work in concert to secure the guard 200 within the gutter in the position depicted in FIG. 3.

As can also be appreciated from FIG. 5, the combination of the K-shaped gutter 100, and the reinforcing member 200 (as depicted and described herein), essentially form a box-like structure when viewed in a cross sectional side view (e.g., FIG. 5). Due to the nature of the typical K-shaped gutter 100, and the design of the reinforcing member 200 (and the manner in which the reinforcing member 200 is mated to the K-shaped gutter 100, as depicted and described herein), this resulting box-like structure is not only resistant to collapse when subjected to loads (e.g. load F1 of FIG. 5, and load F2 of FIG. 6), but also allows a certain degree of deformation of the resulting gutter assembly 10 (FIGS. 3 and 4) so that the gutter assembly is somewhat resistant to tearing away from the mounting (e.g., at the point where fasteners 99, FIG. 4, secure the gutter apparatus 10 to a mounting member) when subjected to anticipated external loads and forces.

Preferably, the gutter 100 and the reinforcing member 200 (which together comprise a gutter system 10, as depicted in FIGS. 3 and 4) are each fabricated from a material having a spring-type resilience property such that one or both of the gutter 100 and the reinforcing member 200 can be deflected (or deformed, in an angular direction and/or a torsional direction) by as much as 25% (or at least by 20%, or by 15%, or even by 5-10%), and thereafter return to essentially the same shape as prior to the deflection. Acceptable materials of fabrication for the gutter 100 and/or the reinforcing member 200 include (without limitation) 22, 24 and 26 gauge steel sheet, as well as sheet aluminum.

With reference to FIGS. 1-4, a method of installing the reinforcing member 200 into a K-style gutter such as the gutter 100 can include positioning the reinforcing member 200 between the front wall 110 and the rear wall 101 of the gutter. Such an installation method can include positioning the reinforcing member 200 relative to the gutter 100 such that the second leg 222 of the reinforcing member is substantially nested within the close inside corner 123 of the gutter. The method can include positioning the reinforcing member 200 relative to the gutter 100 so that the lower outside corner 226 of the reinforcing member is substantially nested within the first inside corner 121 of the gutter. The installation method can include positioning the reinforcing member 200 relative to the gutter 100 in a manner such that the upper outside corner 225 of the reinforcing member is substantially nested within the second inside corner 122 of the gutter. Such a method can include positioning the reinforcing member 200 relative to the gutter 100 so that the rear upper edge 102, or at least a portion of the rear wall 101, of the gutter is substantially nested between the guard lip 211 and the guard rear flange 210. With reference to FIG. 3, the installation method can include placing the mesh material 270 over the reinforcing member 200.

Still referring to FIGS. 1-4, a method of forming the reinforcing member 200 can include providing a substantially flat length of sheet material having a front edge or side, an opposite rear edge or side, an upper surface and an opposite lower surface. The method can include forming in the material one or more of the guard rear flange 210, the guard lip 211, the L-shaped guard front flange that includes the first leg 221 and the second leg 222. The sheet of material from which the reinforcing member 200 is formed according to the exemplary method can be, for example, a length of sheet metal such as sheet steel or sheet aluminum. The forming method can include forming the openings 230. Forming the openings 230 can include, for example, configuring the openings to be louvers. The method of forming the reinforcing member 200 can be accomplished by employing forming and/or fabrication and/or other suitable manufacturing methods known and/or yet to be discovered.

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

What is claimed is:

1. A rain gutter, comprising:

a main body of a rain gutter having a flat rear wall with an upper edge, and a lower edge, and wherein the flat rear wall is disposed in a vertically oriented, and juxtaposed, facing relationship thereagainst a building structural member, and wherein the building structural member supports, at least in part, an adjacent structure which is operable to drain a source of water which has been deposited thereon into the rain gutter, and wherein the main body of the rain gutter has a given length dimension;

a bottom wall of the main body of the rain gutter, and wherein the bottom wall has a rearwardly disposed edge which is fluid sealingly mounted on the lower edge of the rear wall, and which further has an opposite, forward edge which is located in spaced relation relative thereto, and wherein the bottom wall of the main body is planar in shape and extends perpendicularly outwardly relative to the lower edge of the flat rear wall of the main body;

a front wall of the main body of the rain gutter, and which has a first, lowermost, front wall portion which is affixed to, and extends perpendicularly, upwardly from the forward edge of the bottom wall of the main body, and wherein the first, lowermost front wall portion is oriented in parallel, spaced relation relative to the flat rear wall of the main body;

an intermediate, curved wall portion of the front wall of the main body, and which further has a first end, which is made integral with, and extends upwardly and outwardly relative to, the lowermost front wall portion of the main body, and wherein the intermediate, curved wall portion has a distal, second end, and further slopes upwardly, and outwardly, relative to the flat rear wall of the main body;

a second, uppermost front wall portion of the front wall of the main body, and which has a first end which is attached to the distal, second end of the intermediate curved wall portion, and an opposite, second end, and wherein the distal second end of the intermediate, curved wall portion, and the first end of the second, uppermost front wall portion defines a first inside facing corner therebetween, and wherein the second, uppermost front wall portion is oriented in substantially parallel, outwardly spaced relation relative to each of the first, lowermost, front wall portion, and the flat rearwall of the main body;

a forwardly disposed flange which has a first end which is made integral with the opposite, second end of the second, uppermost front wall portion of the front wall of the main body, and wherein the forwardly disposed flange is substantially planar, and oriented in parallel spaced relation relative to the bottom wall of the main body, and which further extends inwardly, and in the direction of the flat rear wall of the main body, and wherein the first end of the forwardly disposed flange, and the second end of the second, uppermost front wall portion define a second, inside facing corner which is located elevationally, above, the first, inside facing corner, and wherein the forwardly disposed flange further defines a second distal end, and wherein the forwardly disposed flange, and the second, uppermost front wall portion are perpendicular, one relative to the other;

a forwardly disposed flange lip which is made integral with second, distal end of the forwardly disposed flange, and which further extends in a direction downwardly relative thereto, and in a forward direction which extends towards the second, uppermost front wall portion, and wherein the forwardly disposed flange lip has a distal end which is located in spaced relation relative to the intermediate, curved wall portion, and the second, uppermost front wall portion, and wherein the forwardly disposed flange lip, and the second, distal end of the forwardly disposed flange define an enclosed inside facing corner which is located in horizontally, inwardly spaced relation relative to the second inside facing corner, and wherein the forwardly disposed flange lip is acutely, angularly oriented relative to, and diverges from, the forwardly disposed flange;

a reinforcing member which matingly cooperates with, and further supports, the main body of the rain gutter on the building structural member, and wherein the reinforcing member has an elongated main body having a length dimension which is substantially equal to the length dimension of the main body of the rain gutter, and which further is defined by a center section which has a rearwardly disposed edge which located adjacent to the flat rear wall of the main body of the rain gutter, and a forward edge which is located adjacent to the second, uppermost front wall portion of the main body of the gutter, and wherein the forward edge of the reinforcing member is located elevationally, below, the forwardly disposed flange, and elevationally above the intermediate curved wall portion, and wherein the reinforcing member has a top and a bottom surface, and wherein the center section further defines a multiplicity of apertures extending through the top and bottom surfaces, and wherein the respective apertures each have a cross sectional dimension which facilitates the passage of water therethrough, while impeding the passage of a source of solid debris material which is deposited on the top surface of the center section, and wherein the top surface of the center section is horizontally oriented, and is further located elevationally below the forwardly disposed flange, and in predetermined, parallel, spaced relation relative to the bottom wall of the main body of the rain gutter;

a rear flange of the reinforcing member, and which is made integral with, and extends vertically, upwardly relative to, the rearwardly disposed edge of the center section of the reinforcing member, and wherein the rear flange further has a distal end which is located elevationally, above, the center section, and wherein the rear flange of the reinforcing member is located in a parallel, juxtaposed relationship relative to the flat rear wall of the main body of the rain gutter;

a rear flange lip which is made integral with the distal end of the rear flange, and which extends, at least in part, both rearwardly and downwardly relative to the rear flange, and wherein the rear flange lip is located in predetermined, parallel, spaced relation relative to the rear flange, and which further defines a gap therebetween the rear flange lip, and the rear flange, and wherein the gap is sized so as to receive the upper edge of the flat rear wall of the main body of the rain gutter therein;

a fastener extending simultaneously through each of the rear flange of the reinforcing member; the flat rear wall of the main body; and the rear flange lip, and wherein the fastener further engages the building structural member so as to affix the reinforcing member, and the flat rear wall of the rain gutter, in a predetermined, fixed location on the building structural member, and wherein the reinforcing member supports the rain gutter, along its length, in an appropriate spatial orientation relative to the building structural member so as to locate the bottom wall of the main body of the rain gutter in a substantially horizontal orientation, and wherein the main body of the rain gutter is affixed and spatially oriented relative to the building structural member by the cooperation of the reinforcing member and the fastener member, alone, and without the further use of any additional supporting brackets which engage the building structural member, and the main body of the rain gutter; and a front flange made integral with the forward edge of the reinforcing member, and which further matingly, and supportingly cooperates with the second, uppermost front wall portion of the front wall of the main body of the rain gutter; the forwardly disposed flange which is made integral with the second, uppermost front wall portion, and which extends inwardly relative thereto; and the forwardly disposed flange lip which is mounted to the forwardly disposed flange, and which further extends downwardly and forwardly relative to the forwardly disposed flange, and wherein the front flange has a first leg which extends vertically, upwardly relative to the forward edge of the reinforcing member, and which further has a distal end, and wherein the front flange has a second leg which is made integral with the distal end of the first leg, and which further extends perpendicularly, inwardly relative thereto, and wherein the second leg of the front flange is located in parallel spaced relation relative to the center section of the reinforcing member, and wherein the distal end of the first leg, and the second leg, define an upper outside facing corner, and the first leg, and the forward edge of the reinforcing member, define a lower, outside facing corner, and wherein the first leg is sized so as to be received and nest, therebetween, the first and second inside facing corners, and wherein the second leg is sized so as to be received, and to nest therebetween, the enclosed inside facing corner which is defined by the forwardly disposed flange, and the forwardly disposed flange lip, and the second inside facing corner, and wherein the first and second legs of the front flange support the bottom wall of the main body of the gutter, and the top surface of the center portion of the reinforcing member, in an appropriate, horizontal, water receiving orientation relative to the building structural member, and wherein a force applied vertically downwardly relative to the center section of the reinforcing member is transmitted to the forwardly disposed flange in a manner such that the first and second legs forcibly engage the forwardly disposed flange, and the front wall of the main body so as to dissipate, at least in part, the applied force, and which further impedes any applied force related damage to the center section, and wherein a force applied to the front wall of the main body of the gutter, and in a direction which extends towards the building structural member is transmitted, at least in part, by way of the front flange to the center portion of the reinforcing member, and then to the building structural member so as to reduce any force related damage from occurring to the front wall of the rain gutter.

* * * * *